United States Patent [19]

Kenyon et al.

[11] Patent Number: 4,882,074

[45] Date of Patent: Nov. 21, 1989

[54] WASH-SOFTENER CONTAINING AMINE ON A CRYSTAL-GROWTH-MODIFIED CARBONATE CARRIER

[75] Inventors: Ian R. Kenyon, Merseyside, United Kingdom; Peter J. Russell, Yokohama, Japan; Thomas Taylor, Cheshire, United Kingdom

[73] Assignee: Lever Brothers Company, New York, N.Y.

[21] Appl. No.: 187,758

[22] Filed: Apr. 29, 1988

[30] Foreign Application Priority Data

Apr. 30, 1987 [GB] United Kingdom ..... 8710292

[51] Int. Cl.[4] ..... D06M 13/38; C11D 3/10; C11D 11/02; C11D 17/06

[52] U.S. Cl. ..... 252/8.8; 252/91; 252/174; 252/174.14; 252/174.16; 252/174.24; 252/544; 252/DIG. 2

[58] Field of Search ..... 252/91, 174.14, 174.24, 252/8.8, 174.13, 174.16, 174, 91, 544

[56] References Cited

U.S. PATENT DOCUMENTS

| | | | |
|---|---|---|---|
| 3,801,511 | 4/1974 | Lemoff | 252/135 |
| 3,850,852 | 11/1974 | Neillie | 252/536 |
| 3,886,098 | 5/1975 | Di Salvo | 252/540 |
| 4,075,117 | 2/1978 | Morton | 252/135 |
| 4,298,493 | 11/1981 | Schreiber | 252/135 |
| 4,311,606 | 1/1982 | Kaeser | 252/135 |
| 4,339,335 | 7/1982 | Wixon | 252/8.8 |
| 4,375,416 | 3/1983 | Crisp | 252/8.7 |
| 4,479,881 | 10/1984 | Tai | 252/8.8 |
| 4,648,979 | 3/1987 | Parslow et al. | 252/8.8 |

FOREIGN PATENT DOCUMENTS

| | | | |
|---|---|---|---|
| 1186458 | 5/1985 | Canada . | |
| 1514276 | 6/1978 | United Kingdom . | |
| 2095274A | 9/1982 | United Kingdom | 252/140 |

*Primary Examiner*—Dennis Albrecht
*Attorney, Agent, or Firm*—Milton L. Honig

[57] ABSTRACT

A particulate composition for softening textile fabrics in the wash comprises:

(a) from 5 to 30% by weight of a primary, secondary or tertiary amine capable of softening fabrics, sorbed onto (b) from 70 to 95% by weight of a particulate carrier comprising a porous crystal-growth-modified carbonate-based salt.

The preferred particulate carrier is the sodium carbonate/sodium sulphate double salt Burkeite modified by means of a polymeric polycarboxylate. The softening composition may be incorporated in a detergent powder, suitably in an amount providing from 0.5 to 15% by weight of amine in the total powder.

12 Claims, No Drawings

WASH-SOFTENER CONTAINING AMINE ON A CRYSTAL-GROWTH-MODIFIED CARBONATE CARRIER

TECHNICAL FIELD OF INVENTION

The present invention relates to detergent compositions that have good cleaning properties and also contain amines capable of softening fabrics during the wash cycle.

BACKGROUND AND PRIOR ART

Detergent compositions capable of cleaning and softening fabrics from the same wash liquor are described in GB 1 514 276, EP 120 528B and EP 173 398A (Unilever). These patent specifications describe detergent compositions containing water-insoluble long-chain amines, preferably tertiary amines, that provide wash cycle softening benefits. In the preparation of spray-dried detergent powders these amines may, if desired, be included in the slurry for spray-drying, but this processing method is not preferred because high spray-tower temperatures may lead to degradation of the amines, with an adverse effect on product quality. The preferred method for incorporating a water-insoluble fabric softening amine in spray-dried powders is to liquefy it by melting or solvent dissolution, and either to spray the melt or solution directly onto the spray-dried base powder, or to spray it onto a suitable carrier material which is then dry-mixed with the spray-dried base powder. The carrier material which has hitherto been chosen for this purpose is sodium perborate monohydrate, because this material is a good water-soluble porous carrier and is a normal constituent of heavy duty detergent powders which is always dry-mixed with the spray-dried base powder because of its unsuitability for spray-drying: it thus provides a convenient route for incorporating amines with minimal process disruption. Sodium perborate monohydrate/tertiary amine premixes for addition to detergent powders are commercially available. They provide excellent delivery of the amine and good softening, but suffer from the major disadvantage that they are hazardous to store and handle because of the powerful oxidizing nature of sodium perborate monohydrate. Sodium perborate tetrahydrate is insufficiently porous and insufficiently water-soluble to be used as a carrier material.

CA 1 186 458 (Bristol-Myers) discloses a granular fabric softening composition, for incorporation in detergent powders, comprising a particulate nitrogen-containing compound, for example, a primary, secondary or tertiary amine, having a particle size of less than 420 μm, and an inert adjuvant, for example, borax or sodium sesquicarbonate. Amines are not generally particulate materials—those suitable for fabric softening are liquids or low-melting-point waxy solids at ambient temperature—and it is necessary to convert them. to finely divided particulate form in order to prepare the composition of CA 1 186 458. The inert adjuvant apparently acts as a diluent rather than a carrier.

EP 221 776A (Unilever), published on 13 May 1987, describes and claims novel porous materials suitable for carrying liquid components in detergent compositions. One such material, crystal-growth-modified Burkeite, is prepared by drying (preferably spray-drying) a slurry containing sodium carbonate and sodium sulphate in an appropriate ratio and a crystal growth modifier, added to the slurry not later than the sodium carbonate so as to influence the growth of crystals of the double salt Burkeite. Crystal-growth-modified Burkeite is characterized by a high capacity for taking up liquid detergent components.

We have now discovered that crystal-growth-modified Burkeite and related carbonate-based salts may be used as inert, non-hazardous carriers for liquid or waxy fabric softening amines. Unexpectedly, a Burkeite/amine premix gives more efficient softening than a sodium perborate monohydrate/amine premix containing the same amount of amine.

DEFINITION OF THE INVENTION

In a first aspect, the present invention provides a composition for softening textile fabrics in the wash, comprising (a) from 5 to 30% by weight of a primary, secondary or tertiary amine capable of softening fabrics, sorbed onto (b) from 70 to 95% by weight of a particulate carrier comprising a porous crystal-growth-modified carbonate-based salt.

For convenience, this composition will be referred to as the premix of the invention.

In a second aspect, the present invention provides a process for the preparation of the premix of the invention, which comprises the steps of:

(i) preparing an aqueous slurry comprising sodium carbonate, optionally together with sodium sulphate and/or sodium bicarbonate, and an effective amount of a crystal growth modifier which is an organic material having at least three carboxyl groups in the molecule, the crystal growth modifier being incorporated in the slurry not later than the sodium carbonate, (ii) drying the aqueous slurry to form a particulate solid comprising a porous crystal-growth-modified carbonate-based carrier salt, (iii) treating the particulate solid obtained in step (ii) with a primary, secondary or tertiary amine capable of softening fabrics.

The third aspect of the present invention is a particulate detergent composition for the cleaning and softening of fabrics, comprising one or more anionic and/or nonionic surfactants, optionally one or more other conventional detergent ingredients, and from 0.5 to 15% by weight of a primary, secondary or tertiary amine capable of softening fabrics, the amine being sorbed onto a particulate carrier comprising a porous crystal-growth-modified carbonate-based salt, in an amount of from 5 to 30% by weight of the amine sorbed onto from 70 to 95% by weight of the particulate carrier, based on the total weight of the amine and the particulate carrier.

DESCRIPTION OF THE INVENTION

The invention is concerned with a fabric softening premix for incorporation in a detergent composition; a process for preparing the premix; and a detergent composition containing it. The premix of the invention contains two essential ingredients: a fabric softening amine, and a particulate carrier material comprising a porous crystal-growth-modified carbonate-based salt.

The fabric softening amine

The fabric softening amine may be primary, secondary or tertiary, but tertiary amines are preferred.

In broad terms, preferred tertiary amines for use in the present invention are materials of the general formula I

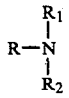

(I)

wherein R represents an alkyl group having from 1 to 6 carbon atoms, and each of $R_1$ and $R_2$, which may be the same or different, represents a saturated or unsaturated, substituted or unsubstituted aliphatic or araliphatic radical containing from 10 to 26 carbon atoms. Preferably each of $R_1$ and $R_2$ represents a $C_{10}$–$C_{26}$ alkyl or alkenyl group which is linear or substantially linear.

Examples of suitable materials include the following:
didecyl methylamine
dilauryl methylamine
dimyristyl methylamine
dicetyl methylamine
distearyl methylamine
diarachadyl methylamine
dibehenyl methylamine
arachadyl behenyl methylamine
or di (mixed arachadyl/behenyl) methylamine
di coco methylamine
di tallow methylamine
di (hardened tallow) methylamine
and the corresponding ethylamines, propylamines and butylamines. An especially preferred material is di (hardened tallow) methylamine, which is commercially available as Armeen (Trade Mark) M2HT from Akzo NV, Genamin (Trade Mark) SH301 from Hoechst AG and Noram (Trade Mark) M2SH from the CECA Company.

Other tertiary amines having useful softening properties are those of the formula I in which R, the short-chain substituent, is a benzyl, hydroxymethyl, hydroxyethyl, hydroxypropyl, allyl or 2-cyanoethyl group. Of these, di (hardened tallow) benzylamine and di (hardened tallow) allylamine are preferred.

Primary and secondary amines may also be used in the present invention, but are generally of less interest than the tertiary amines. These may be materials of the general formula II $$R_3R_4\,NH \qquad \text{(II)}$$

wherein $R_3$ is a $C_{10}$–$C_{26}$ radical as defined previously for $R_1$ and $R_2$, and $R_4$ is either a $C_{10}$–$C_{26}$ radical as defined for $R_3$, or a short-chain radical as defined above for R, or a hydrogen atom.

These amines are liquids or waxy solids at ambient temperature and require a solid carrier before they can be incorporated in a particulate detergent composition. For example, di coco methylamine is a liquid at room temperature and di (hardened tallow) methylamine melts at 30° C.; and the primary and secondary amines are generally waxy solids with melting points of 62° C. or below.

The particulate carrier material

In accordance with the present invention, the fabric softening amine is sorbed on a particulate carrier material which comprises, and preferably consists substantially wholly of, a porous crystal-growth-modified carbonate-based carrier salt. These salts are disclosed in the aforementioned EP 221 776A (Unilever), and in our copending Applications of even date (cases C.3173 and C.3174).

Three different porous carbonate-based crystal-growth-modified salts are of especial interest: sodium carbonate itself, mainly in monohydrate form but containing some anhydrous material; sodium sesquicarbonate, which is a hydrated carbonate/bicarbonate double salt of the formula $$Na_2CO_3.NaHCO_3.2H_2O;$$

and Burkeite, an anhydrous carbonate/sulphate double salt of the formula $$2Na_2SO_4.Na_2CO_3.$$

All three salts exhibit crystal growth modification, when prepared by drying a slurry containing the appropriate salt(s) and a crystal growth modifier added to the slurry not later than the sodium carbonate. The crystal growth modified materials are characterized by small needle-like crystals interspersed with very small pores, and are very useful as carriers of liquid detergent components.

The use of the sodium carbonate/sodium sulphate double salt Burkeite represents an especially preferred embodiment of the invention. This material forms small crystals (about 10 μm) but in the normal block-like crystal form these are packed together in dense aggregates and the material has a low absorptivity for liquids. As explained in the aforementioned EP 221 776A, Burkeite can be converted to a more desirable needle-shaped crystal form in the slurry by the addition of a low level of a polycarboxylate material at a particular stage in the slurry-making process. Crystal-growth-modified spray-dried Burkeite contains small needle-shaped crystals which can be shown by mercury porosimetry to be interspersed to a large extent with very small (<3 5 μm) pores. This material is capable of absorbing and retaining substantial quantities of liquid organic detergent components as a direct result both of a change in crystal form and of a less dense form of crystal packing, giving particles of greater porosity than those produced in the absence of a crystal growth modifier. The modified crystal structure can be recognized by optical or electron microscopy.

The crystal-growth-modified salt is prepared by drying a slurry, the preferred drying method being spray-drying. The slurry contains, as essential ingredients, sodium carbonate, water and a polycarboxylate crystal growth modifier. Optionally sodium sulphate and/or sodium bicarbonate may be present depending on the porous carrier salt desired. Minor amounts of other materials may also be included as explained below.

It is essential that the polycarboxylate crystal growth modifier be present in the slurry at a sufficiently early stage to influence the crystal growth of the carbonate carrier salt. It must accordingly be incorporated in the slurry not later than the time at which the sodium carbonate is added. If sodium sulphate and/or sodium bicarbonate is or are present, the crystal growth modifier is preferably incorporated not later than the addition of both the sodium carbonate and the other salt(s).

In batch slurry-making, there is no difficulty in arranging for the ingredients to be added in the appropriate order. In continuous slurry-making processes all components are added substantially simultaneously, but once the start-up period is over the inorganic salts will in practice always encounter a slurry containing some crystal growth modifier.

The water used to prepare the carbonate slurry is preferably relatively soft. Desirably water of hardness not exceeding 15° (French) is used.

The sodium carbonate used in the carbonate slurry may be of any type. Synthetic light soda ash has been found to be especially preferred; natural heavy soda ash is intermediate, while synthetic granular soda ash is the least preferred raw material. All grades of sodium sulphate are suitable for use in the invention, provided that they are not heavily contaminated with other salts such as salts of calcium or magnesium.

If the carrier salt is Burkeite, the extent of its formation in the slurry will of course depend on the ratio of sodium carbonate and sodium sulphate present. This must be at least 0.03:1 (by weight) in order for the resulting spray-dried material to have a useful level of porosity; and it is preferably at least 0.1:1 and more preferably at least 0.37:1, this latter figure representing the stoichiometric ratio for Burkeite formation. Thus it is preferred that as much as possible of the sodium sulphate present be in the form of Burkeite. Any excess sodium carbonate present will itself be in a crystal-growth-modified form.

The stoichiometric weight ratio for sodium sesquicarbonate formation (sodium carbonate: sodium bicarbonate) is 1.26:1. During spray-drying some dehydration of sesquicarbonate occurs, to produce bicarbonate and carbonate; and some decomposition of bicarbonate to carbonate occurs. Furthermore, crystallisation in the slurry may not always be complete, so the yield of sesquicarbonate may be as low as 50% of theoretical. Preferably the weight ratio of sodium carbonate to sodium bicarbonate used in preparing a sesquicarbonate slurry is within the range of from 1.5:1 to 1:1.

The preferred order of addition of the salts to a Burkeite slurry is for sodium sulphate to be added before sodium carbonate. This has been found to give a higher yield of Burkeite and the Burkeite thus formed appears to have a higher useful porosity. In this preferred method, the crystal growth modifier should be added to the slurry either before the addition of both salts, or after the addition of the sodium sulphate and before the addition of the sodium carbonate.

Similar considerations apply to the use of crystal-growth-modified sodium sesquicarbonate.

The polycarboxylate crystal growth modifier is an organic material containing at least three carboxyl groups in the molecule but we have found that it cannot be generically defined further in purely structural terms; it is also difficult to predict how much will be required. It can, however, be defined functionally with reference to Burkeite crystal growth modification, as an organic material having three or more carboxyl groups in the molecule, which, when incorporated at a suitable level in a slurry to which sodium carbonate and sodium sulphate in a weight ratio of at least 0.03:1 are subsequently or simultaneously added, gives on drying a powder having a pore size distribution, as measured by mercury porosimetry, of at least 300 $cm^3$ of pores $<3.5$ $\mu m$ per kg of powder.

This porosity figure, measured by the recognized technique of mercury porosimetry, has been found to correlate well with the capacity to take up and retain liquid detergent components such as nonionic surfactants.

For the purposes of selecting a crystal growth modifier on the basis of pore size distribution, it is necessary to use a simple slurry containing only sodium sulphate, sodium carbonate, the crystal growth modifier and water, because the presence of other materials will influence the porosity. This model system can then be used to select a crystal growth modifier for use in more complex slurries where other materials may be present, and/or for use in modifying the crystal growth of other carbonate salts, for example, sodium carbonate itself or sodium sesquicarbonate.

As hinted above, the carbonate slurry for use in the present invention may advantageously contain minor amounts of other components. A small amount of anionic surfactant, for example, increases powder porosity and increases slurry stability; a small amount of nonionic surfactant improves slurry pumpability and atomization; and sodium silicate reduces the friability of the carrier material and aids in handling.

The crystal growth modifier is a polycarboxylate. Monomeric polycarboxylates, for example, salts of ethylenediaminetetraacetic acid, nitrilotriacetic acid and citric acid, may be used but the levels required are rather high, for example, 5 to 10% by weight based on the total amount of sodium carbonate and, if present, sodium sulphate and/or sodium bicarbonate. Preferred polycarboxylate crystal growth modifiers used in the invention are polymeric polycarboxylates. Amounts of from 0.1 to 20% by weight, preferably from 0.2 to 5% by weight, based on the total amount of sodium carbonate and, if present, sodium sulphate and/or sodium bicarbonate, are generally sufficient.

The polycarboxylate crystal growth modifier preferably has a molecular weight of at least 1000, advantageously from 1000 to 300 000, especially from 1000 to 250 000. Carrier salts having especially good dynamic flow rates may be prepared if the carbonate slurry incorporates polycarboxylate crystal growth modifiers having molecular weights in the 3000 to 100 000 range, especially 3500 to 70 000 and more especially 10 000 to 70 000 All molecular weights quoted herein are those provided by the manufacturers.

Preferred crystal growth modifiers are homopolymers and copolymers of acrylic acid or maleic acid. Of especial interest are polyacrylates, acrylic acid/maleic acid copolymers, and acrylic phosphinates.

Suitable polymers, which may be used alone or in combination, include the following:

salts of polyacrylic acid such as sodium polyacrylate, for example Versicol (Trade Mark) E5 E7 and E9 ex Allied Colloids, average molecular weights 3500, 27 000 and 70 000; Narlex (Trade Mark) LD 30 and 34 ex National Adhesives and Resins Ltd, average molecular weights 5000 and 25 000 respectively; Acrysol (Trade Mark) LMW-10, LMW-20, LMW-45 and A-IN ex Rohm & Haas, average molecular weights 1000, 2000, 4500 and 60 000; and Sokalan (Trade Mark) PAS ex BASF, average molecular weight 250 000;

ethylene/maleic acid copolymers, for example, the EMA (Trade Mark) series ex Monsanto;

methyl vinyl ether/maleic acid copolymers, for example, Gantrez (Trade Mark) AN119 ex GAF Corporation;

acrylic acid/maleic acid copolymers, for example, Sokalan (Trade Mark) CP5 ex BASF; and acrylic phosphinates, for example, the DKW range ex National Adhesives and Resins Ltd or the Belsperse (Trade Mark) range ex Ciba-Geigy AG, as disclosed in EP 182 411 A (Unilever).

Mixtures of any two or more crystal growth modifiers may if desired be used in the premixes of the invention.

The slurry will generally contain from 45 to 60% by weight, of water.

Slurry-making conditions may be chosen to maximize the yield of modified crystals obtained. Sodium carbonate and Burkeite slurries are best prepared at relatively high temperatures, preferably above 80° C., more preferably from 85 to 95° C.; while a sodium sesquicarbonate slurry is best prepared at a temperature not exceeding 65° C., preferably from 50 to 60° C., in order to minimize decomposition of the sodium bicarbonate present.

On drying a slurry containing crystal-growth-modified Burkeite, which is an anhydrous material, the double salt survives unchanged in the dried powder. Crystal-growth-modified sodium carbonate monohydrate and sodium sesquicarbonate will generally lose some water of crystallisation on drying, depending on the drying conditions, but this does not adversely affect the porosity and indeed may introduce further useful porosity.

The particulate carrier material used in the present invention may consist wholly of the porous carbonate-based salt, and preferably consists to an extent of at least 50% by weight of that salt. It is possible that less than complete conversion to the desired salt will occur in the slurry; in the case of a double salt such as Burkeite or sodium sesquicarbonate, 100% conversion is clearly impossible if the ratio of the two constituent simple salts is not exactly stoichiometric, and it is likely that an excess of one or other of the constituent salts may be present. If desired, too, the salt may deliberately be diluted with another carrier material. Preferably, however, the particulate carrier material consists predominantly or substantially wholly of the porous carbonate-based carrier salt.

The fabric softening premix

The first aspect of the invention is a composition, referred to herein as a premix, for softening fabrics. This consists essentially of from 5 to 30% by weight of fabric softening amine carried on from 70 to 95% by weight of particulate carrier material, the percentages being based on the sum of fabric softening amine and particulate carrier material. If desired, minor amounts of other materials may be present provided that they do not interfere with the fabric softening effect of the amine or with its delivery in the wash.

The premix is prepared by treating the particulate carrier material with the fabric softening amine. The amines are water-insoluble materials and most are waxy solids at ambient temperature. A preferred method for preparing the premix is to liquefy the amine by melting or dissolving in a solvent, and to spray it onto the particulate carrier material. Spraying should be through a fine nozzle in order to obtain maximum dispersion of the amine over the carrier material. During the spraying process, the particulate carrier material is advantageously agitated in apparatus, for example, a rotating drum, that continually presents a changing surface of powder to the sprayed liquid; and the spray nozzle is advantageously angled so that liquid that penetrates the powder curtain falls on further powder rather than the shell of the drum itself.

The amount of amine in the premix preferably ranges from 10 to 25% by weight, and the amount of particulate carrier material preferably ranges from 75 to 90% by weight, based on the sum of those two materials and disregarding any minor amounts of other materials present.

The premix is useful as a product in its own right that may be added to the washing machine, via the dispenser or directly onto the soiled fabrics, before carrying out a wash using a conventional detergent composition. In a preferred embodiment, however, the premix is incorporated in a particulate detergent composition.

The particulate detergent composition

The premix of the invention may suitably be incorporated in a particulate detergent composition in an amount such that the final composition comprises from 0.5 to 15% by weight, preferably from 2 to 10% by weight, of the fabric softening amine. This range appears to be most appropriate for matching of softening and cleaning power in a detergent composition. The premix is suitably incorporated by dry mixing.

The particulate detergent composition may contain all or any of the conventional ingredients. It will generally contain one or more anionic and/or nonionic surfactants and one or more detergency builders.

Anionic surfactants are well known to those skilled in the detergents art. Examples include alkylbenzene sulphonates, particularly sodium linear $C_8$–$C_{15}$ alkylbenzene sulphonates having an average chain length of $C_{11}$–$C_{13}$; primary and secondary alcohol sulphates, particularly sodium $C_{12}$–$C_{15}$ primary alcohol sulphates; olefin sulphonates; alkane sulphonates; and fatty acid ester sulphonates.

Examples of suitable nonionic surfactants are the primary and secondary alcohol ethoxylates, especially the ethoxylated $C_{12}$–$C_{15}$ primary and secondary alcohols.

It may also be desirable to include one or more soaps of fatty acids. The soaps which can be used are preferably sodium soaps derived from naturally occurring fatty acids, for example the fatty acids from coconut oil, beef tallow, sunflower or hardened rapeseed oil.

The sodium carbonate present in the carbonate-based carrier salt acts as a detergency builder, but will not generally be present in a sufficient amount to provide adequate building. Preferred builders for inclusion in the detergent composition of the invention include phosphates, for example, orthophosphates, pyrophosphates and (most preferably) tripolyphosphates. Non-P builders that may be present include, but are not restricted to, sodium carbonate, crystalline and amorphous aluminosilicates, soaps, sulphonated fatty acid salts, citrates, nitrilotriacetates and carboxymetyloxsuccinates. Polymeric builders, for example, polycarboxylates such as polyacrylates, acrylic/maleic copolymers and acrylic phosphinates, may also be present, generally but not exclusively to supplement the effect of another builder such as sodium tripolyphosphate or sodium aluminosilicate. The polymers listed previously as crystal growth modifiers generally have builder efficacy and any of these may with advantage also be included in the detergent composition of the invention.

Other ingredients that may be present include alkali metal silicates, antiredeposition agents, antiincrustation agents and fluorescers.

All the ingredients so far mentioned may be incorporated in a slurry and spray-dried to form a powder, although some nonionic surfactants may give rise to unacceptable levels of tower emission. The detergent composition of the invention may also contain various ingredients that are unsuitable for slurrying or spray-drying or that interfere with the spray-drying process, and such ingredients may be incorporated by spraying, dry-mixing or granulation. Examples of such ingredients are enzymes; bleaches, bleach precursors, or bleach activators; inorganic salts such as sodium sulphate, as described and claimed in EP 219 328A (Unilever); or sodium silicate as described and claimed in our copending Applications No.86 08291 filed on 4 April 1986 and Nos.86 09042 and 86 09043 filed on 14 April 1986; lather suppressors; perfumes; dyes; and coloured noodles or speckles. Further examples of ingredients best incorporated by postdosing will readily suggest themselves to the skilled detergent formulator.

EXAMPLES

The invention is illustrated by the following non-limiting Examples, in which parts and percentages are by weight unless otherwise stated.

Examples I and II

A Burkeite slurry was prepared to the following composition:

| | parts |
|---|---|
| Sodium polyacrylate (molecular weight 5000) | 2.0* |
| Sodium sulphate | 67.0 |
| Sodium carbonate | 25.0 |
| Nonionic surfactant | 2.0 |
| Water | 114.0 |
| | 210.0 |

*2.2% based on sodium sulphate + sodium carbonate. The sodium carbonate to sodium sulphate ratio was 0.37:1 (stoichiometric).

The order of addition of ingredients to the crutcher was as follows: water to 85° C., sodium polyacrylate (crystal growth modifier), sodium sulphate, sodium carbonate, sodium silicate, nonionic surfactant.

The slurry was spray-dried to a moisture content of 2.5%, so that the parts by weight given above represent weight percentages of the dried Burkeite.

A premix (Premix X) according to the invention was prepared by melting 20 parts by weight of di (hardened tallow) methylamine and spraying the molten amine onto 80 parts by weight of the Burkeite.

Premix X was compared with four premixes according to the prior art containing the same amine, in which the carrier material was sodium perborate monohydrate:

| | parts | |
|---|---|---|
| | Perborate | Amine |
| A | 82 | 18 |
| B (ex Interox) | 79 | 21 |
| C (ex Atochem) | 79 | 21 |
| D (ex Degussa) | 78 | 22 |

Premixes B, C and D were commercially available materials.

Two different detergent powders were prepared to the formulations shown in Table 1, by spray-drying and postdosing.

TABLE 1

| | Powder I % | Powder II % |
|---|---|---|
| SPRAY-DRIED BASE | | |
| Alkylbenzene sulphonate | 6.5 | 7.1 |
| Nonionic surfactant | 2.0 | 2.3 |
| Soap | 1.0 | 1.0 |
| Sodium alkaline silicate | 7.0 | 10.0 |
| Sodium tripolyphosphate | 15.0 | 19.0 |
| Trisodium orthophosphate | 5.0 | — |
| Sodium sulphate | 37.47 | 31.9 |
| Sodium carbonate | — | 5.0 |
| Sodium polyacrylate | 0.63 | — |
| Fluorescer | 0.19 | 0.13 |
| EDTA | 0.15 | 0.12 |
| SCMC | 0.50 | 0.13 |
| Water | 6.12 | 7.74 |
| TOTAL | 81.41 | 84.60 |
| POST-DOSED INGREDIENTS | | |
| Sodium perborate monohydrate | 14.0 | — |
| Sodium perborate tetrahydrate | — | 11.0 |
| Sodium sulphate | 3.8 | 4.18 |
| Enzyme | 0.36 | 0.20 |
| Perfume | 0.28 | — |
| TOTAL | 99.85 | 100.00 |

Test detergent compositions were prepared by postdosing slightly differing levels of the premixes to each spray-dried base powder such that the final levels of amine in each composition would be the same.

Example I (Powder I with 3.8% amine)

| | Powder I (parts) | Premix (parts) |
|---|---|---|
| IX | 81 | X 19 |
| IA | 79 | A 21 |
| IB | 82 | B 18 |
| IC | 82 | C 18 |
| ID | 82.7 | D 17.3 |
| IE (control) | 100 | — — |

Example II (Powder II with 4.0% amine)

| | Powder II (parts) | Premix (parts) |
|---|---|---|
| IIX | 80 | X 20 |
| IIA | 78 | A 22 |
| IIB | 81 | B 19 |
| IIC | 81 | C 19 |
| IID | 81.8 | D 18.2 |
| IIE (control) | 100 | — — |

Softening experiments were carried out in tergotometers at 40° C. in 24° H. water, washing for 15 minutes followed by two rinses each of 2 minutes at an agitation rate of 60 rpm. A concentration of each product of 5 g/l was used, and desized new fabric and preharshened fabric used as monitors. Softness was assessed by a technique developed by the Applicants in which a stylus sensitive to the small deformations characteristic of harshness is drawn over the fabric surface. Its signal output is summed over a period of 18 seconds and displayed as a total mV reading: the higher the reading, the harsher the fabric. The difference required for significance is ± 5mV.

The results were as follows:

-continued

Example I

| | mV readings | |
|---|---|---|
| | Desized fabric | Preharshened fabric |
| IX | 214 | 288 |
| IA | 218 | 308 |
| IB | 224 | 305 |
| IC | 216 | 309 |
| ID | 215 | 302 |
| IE | 223 | 319 |
| Original fabric | 210 | 430 |

Example II

| | mV readings | |
|---|---|---|
| | Desized fabric | Preharshened fabric |
| IIX | 177 | 221 |
| IIA | 179 | 249 |
| IIB | 197 | 243 |
| IIC | 187 | 240 |
| IID | 183 | 232 |
| IIE | 198 | 266 |
| Original fabric | 173 | 427 |

As normally occurs, the desized new fabric became harsher on washing and this was not fully counteracted by the softener present. However, the compositions IX and IIX according to the invention were better than any of the comparative products and came closest to restoring the original softness.

The other test fabric used had been preharshened in a washing machine, and was softened somewhat by the test procedure even when the control products IE and IIE without softener were used; this again is normal. The products with softener were, however, significantly better, and the products IX and IIX according to the invention gave significantly better softening than the comparative products using sodium perborate monohydrate/ amine premixes.

We claim:

1. A particulate detergent composition for the cleaning and softening of fabrics, comprising a surfactant selected from the group consisting of anionic, nonionic and surfactant mixtures thereof, and from 0.5 to 15% by weight of an amine selected from the group consisting of a primary, secondary and tertiary amine capable of softening fabrics, the amine being sorbed onto a particulate carrier comprising needle-shaped crystals of a porous crystal-growth-modified carbonate-based salt selected from the group consisting of hydrated carbonate/bicarbonate double salt, anhydrous carbonate/-sulfate double salt and sodium carbonate monohydrate, wherein said carbonate-based salt incorporates at least 0.1%, calculated on the total amount of carbonate, sulfate and bicarbonate, of a crystal-growth-modifier selected from the group consisting of homopolymers and copolymers of acrylic acid and maleic acid, wherein said salt has a pore size distribution of at least 300 $cm^3$ of pores $<3.5$ $\mu m$ per kg of carrier before absorption of said amine thereon, in an amount of from 5 to 30% by weight of the amine sorbed onto from 70 to 95% by weight of the particulate carrier, calculated on the total weight of the amine and the particulate carrier.

2. A composition for softening textile fabrics in the wash, comprising:

(a) from 5 to 30% by weight of a primary, secondary or tertiary amine capable of softening fabrics, sorbed onto (b) from 70 to 95% by weight of a particulate carrier comprising needle-shaped crystals of a porous crystal-growth-modified carbonate-based salt selected from the group consisting of hydrated carbonate/bicarbonate double salt, anhydrous carbonate/sulfate double salt and sodium carbonate monohydrate, wherein-carbonate-based said salt incorporates at least 0.1%, calculated on the total amount of carbonate, sulfate and bicarbonate, of a crystal-growth-modifier selected from the group consisting of homopolymers and copolymers of acrylic acid and maleic acid, and said salt has a pore size distribution of at least 300 $cm^3$ of pores $<3.5$ $\mu m$ per kg of carrier before absorption of said amine thereon.

3. A composition as claimed in claim 2, wherein the amine is a tertiary amine of the general formula I

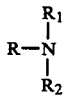

(I)

wherein R represents an alkyl group having from 1 to 6 carbon atoms, and each of $R_1$ and $R_2$, which may be the same or different, represents a saturated or unsaturated, substituted or unsubstituted aliphatic or araliphatic radical containing from 10 to 26 carbon atoms.

4. A composition as claimed in claim 2, wherein the amine is a compound wherein each of $R_1$ and $R_2$ represents an alkyl or alkenyl group containing from 10 to 26 carbon atoms.

5. A composition as claimed in claim 2, wherein the porous crystal-growth-modified carbonate-salt is Burkeite.

6. A composition as claimed in claim 2, comprising from 10 to 25% by weight of the amine and from 75 to 90% by weight of the particulate carrier material.

7. A composition as claimed in claim 2 wherein the crystal-growth-modifier is a polymeric polycarboxylate having a molecular weight of from 1,000 to 300,000.

8. A composition as claimed in claim 2 wherein the homopolymers and copolymers of acrylic acid are selected from the group consisting of polyacrylates, acrylic acid/maleic acid copolymers and acrylic phosphinates.

9. A process for the preparation of a composition as claimed in claim 2, which comprises:

(i) preparing an aqueous slurry comprising a carrier forming material selected from the group consisting of sodium carbonate, sodium sulphate, sodium bicarbonate, and mixtures thereof, along with an effective amount of a crystal growth modifier selected from the group consisting of homopolymers and copolymers of acrylic acid and maleic acid, the crystal growth modifier being incorporated in the slurry not later than the sodium carbonate, (ii) drying the aqueous slurry to form a particulate solid comprising a porous crystal-growth-modified carbonate-based carrier salt, (iii) sorbing onto the particulate solid obtained in step (ii) a primary, secondary or tertiary amine capable of softening fabrics.

10. A process as claimed in claim 9, wherein the aqueous slurry comprises sodium carbonate and sodium sulphate in a weight ratio of at least 0.03:1, whereby the particulate solid obtained in step (ii) comprises crystal-growth-modified Burkeite.

11. A process as claimed in claim 9, wherein the crystal growth modifier is a polymeric polycarboxylate having a molecular weight of from 1000 to 300,000.

12. A process as claimed in claim 9, wherein the crystal growth modifier is a polyacrylate.

* * * * *